US005656193A

United States Patent [19]

Lopez et al.

[11] Patent Number: 5,656,193

[45] Date of Patent: Aug. 12, 1997

[54] PILASTER FORM

[75] Inventors: Manuel Lopez, Arlington Heights; Michael J. Miller, Medinah, both of Ill.

[73] Assignee: Symons Corporation, Des Plaines, Ill.

[21] Appl. No.: 384,788

[22] Filed: Feb. 7, 1995

[51] Int. Cl.[6] ..... E04G 11/06

[52] U.S. Cl. ..... 249/29; 249/47; 249/158; 249/165

[58] Field of Search ..... 249/26, 29, 33.47, 249/158, 163, 165

[56] References Cited

U.S. PATENT DOCUMENTS

| | | | |
|---|---|---|---|
| 3,833,199 | 9/1974 | Frake | 249/33 |
| 4,227,672 | 10/1980 | Cunningham | 249/28 |
| 4,722,541 | 2/1988 | Carlson et al. | 249/192 |
| 5,174,909 | 12/1992 | Ward | 249/44 |

FOREIGN PATENT DOCUMENTS

| | | | |
|---|---|---|---|
| 216404 | 5/1924 | United Kingdom | 249/29 |
| 259037 | 10/1926 | United Kingdom | 249/29 |

OTHER PUBLICATIONS

"Pilaster Forming", Symons Corporation, Mar. 1988.
"Pilaster Forms", Symons Corporation, undated.

*Primary Examiner*—Robert J. Warden
*Assistant Examiner*—E. Leigh Dawson
*Attorney, Agent, or Firm*—Marshall, O'Toole, Gerstein, Murray & Borun

[57] ABSTRACT

In order to more efficiently form a pilaster, a pilaster form is disclosed which includes a first side unit and a second side unit together with a filler which is adapted to be interconnected with the first and second side units. The first side unit is adapted for interconnection with a first section of a wall form in order to form a first side of a pilaster. The filler is adapted for interconnection with the first and second side units of the pilaster form to form an outwardly facing surface of the pilaster. The second side unit is adapted for interconnection with a second section of the wall form in order to form a second side of the pilaster. With this arrangement, the filler is releasably secured to the first and second side units at any one of a plurality of positions in relation to the wall form to permit the forming of the pilaster in a plurality of depths relative to the concrete wall.

20 Claims, 3 Drawing Sheets

PILASTER FORM

FIELD OF THE INVENTION

The present invention is generally directed to the field of accessories and components for concrete forms and the like and, more particularly, a pilaster form for use in forming a pilaster for a concrete wall in any of a plurality of widths and depths.

BACKGROUND OF THE INVENTION

In recent years, it is well recognized that there have been significant advancements in the field of concrete forming. It is known, for instance, that there are a wide variety of forming systems which are now available for nearly every conceivable concrete forming application. In addition, there have been a number of different types of accessories and components developed for use with the various concrete forming systems.

As will be appreciated, a variety of forming systems have been specifically developed for particular applications. Among these are forms for bridge piers, beams and large walls, forms for round tanks and curved walls, forms for heavy construction, box culvert travellers, room tunnel forms, bridge deck systems, forms for curbs and gutters, and even specialized designs for unique concrete forming requirements. In addition to these unique types of systems, it is well known that concrete forming is entirely common for pouring walls.

In wall forming systems, it is typical for the panels to be designed in such manner as to be vertically positioned. The panels and fillers are conventionally available in a variety of heights and backing bar configurations for specific applications. When workmen utilize such wall forming systems, there are oftentimes still additional important requirements.

More particularly, it is not at all uncommon for a concrete wall to be formed so as to have one or more pilasters. There are components that have been and can be built for the purpose of forming a pilaster but, generally speaking, they have lacked the degree of versatility that would be desirable. Specifically, this has been true for plywood systems designed especially for residential and low industrial concrete walls.

In these systems, each form typically has attached hardware that secures the ties and subsequent form. This connection also helps to align the formwork. Further, water brackets typically slide over hex headbolts and accept standard lumber to bring formwork into final alignment.

While these systems are extremely useful, it has remained to provide a truly versatile pilaster form that permits the forming of a pilaster in any of a plurality of widths and depths in relation to a concrete wall.

The present invention is directed to overcoming one or more of the foregoing problems and achieving one or more of the resulting objects.

SUMMARY OF THE INVENTION

It is a principal object of the present invention to provide a pilaster form especially adapted for utilization with a standard concrete wall forming system. It is a further object of the present invention to provide a pilaster form having sufficient versatility to allow forming a pilaster for a concrete wall in any of a plurality of different selected ways. It is another object of the present invention to provide a pilaster form for forming a pilaster in any of a plurality of widths and depths in relation to a concrete wall.

Accordingly, the present invention is directed to a pilaster form for use in forming a pilaster for a concrete wall comprising a first side unit, a second side unit, and a filler. The first side unit of the pilaster form is adapted for interconnection with a first section of a wall form to form a first side of a pilaster and there are means integral with either the first side unit or the first; section of the wall form for releasably securing the first side unit to the first section of the wall form. The second side unit of the pilaster form is adapted for interconnection with a second section of the wall form to form a second side of the pilaster and there are means integral with either the second side unit or the second section of the wall form for releasably securing the second side unit to the second section of the wall form. The filler of the pilaster form is adapted for interconnection with the first and second side units of the pilaster form to form an outwardly facing surface of the pilaster and there are means integral with at least either the first and second side units or the filler for releasably securing the filler to the first and second side units of the pilaster form. With this arrangement, the filler releasable securing means is operable to releasably secure the filler at any one of a plurality of positions in relation to the wall form.

More specifically, the positions at which the filler can be releasably secured in relation to the wall form are such as to permit the forming of the pilaster in a plurality of depths in relation to the concrete wall. In the exemplary embodiment, the first and second side units each have a face for forming the sides of the pilaster together with first and second edges extending along opposite sides of the corresponding one of the faces. Also, the side unit releasable securing means each advantageously includes a mounting block integral with the corresponding one of the side units with each of the mounting blocks having an integral latch bolt for receiving or carrying a latch. Still further, the side unit releasable securing means each preferably includes at least a latch integral with one and a latch bolt integral with the other of the corresponding ones of the side units and wall form sections.

With regard to the filler, it also advantageously has a face for forming the outwardly facing surface of the pilaster together with first and second edges extending along opposite sides thereof. With this arrangement, the filler releasable securing means preferably includes at least a latch integral with one and a latch bolt integral with the other of the corresponding ones of the side units and the filler.

In a highly preferred embodiment, the face of each of the first and second side units is generally planar and the first and second edges extending along opposite sides of the corresponding one of the faces are generally parallel. In similar fashion, the face of the filler for forming the outwardly facing surface of the pilaster is preferably generally planar and the first and second edges extending along opposite sides of the face of the filler are preferably generally parallel.

Still additionally, each of the first and second side units advantageously has a return bend integral with one of the first and second generally parallel edges to provide a wall forming flange and a wall form abutting flange. It is also preferred for each of the sections of the wall form to have a generally planar face for forming the concrete wall and, further, for each of the sections of the wall form to also have a side edge for abutment by one of the wall form abutting flanges. With this construction, each of the wall forming flanges advantageously has a generally planar face to be secured generally coplanar with the generally planar face of the section of the wall form against which it is abutted for forming the concrete wall.

Advantageously, each of the wall form abutting flanges has a generally planar surface to be secured in abutment with the side edge of one of the sections of the wall form for forming the concrete wall.

In a highly preferred embodiment, each of the side unit releasable securing means includes a plurality of vertically spaced mounting blocks integral with the corresponding one of the side units and each of the vertically spaced mounting blocks has an integral latch bolt for receiving or carrying a latch. With these particular features of construction, the filler releasable securing means advantageously includes at least a plurality of latches integral with one and a plurality of latch bolts integral with the other of the corresponding ones of the side units and the filler. Still further, each of the side unit releasable securing means most advantageously includes a plurality of vertically spaced latch bolts which are integral with the corresponding one of the sections of the wall form with each of the latch bolts being provided so as to receive or carry a latch.

In the most highly preferred embodiment, the filler releasable securing means includes a plurality of angles vertically secured in parallel horizontally spaced relation on an outer surface of each of the first and second side units with each of the angles carrying a selected number of the latch bolts and each of the latch bolts being adapted to receive and/or carry a latch for interconnection with the filler. The latch bolts preferably each extend generally perpendicular to a flange of the angle so as to extend in a direction generally parallel to the outer surface of the respective one of the first and second side units with the latch bolts each threadingly engaging the flange of the respective ones of the angles for threaded movement toward and away from the respective ones of the flanges. In one form of the invention, a plurality of the latches are integrally associated with one of the edges of the filler and a plurality of latch bolts are integral with the other of the edges of the filler such that the latch bolts integrally associated with the angles of one of the side units is adapted to receive a corresponding one of the latches integrally associated with the one of the edges of the filler.

With this arrangement, the pilaster form advantageously includes a plurality of latch clips each of which is adapted to be interconnected to one of the latch bolts integral with the other of the edges of the filler and also to be interconnected with a corresponding one of the latch bolts integral with one of the angles of the other of the side units. Alternatively, each of the latch bolts integrally associated with the angles of the other of the side units carries a latch for interconnection with the filler such that the latches are adapted to be interconnected with a corresponding one of the latch bolts integral with the filler. With either of these arrangements, the filler releasable securing means advantageously further includes a plurality of vertically extending rows of apertures in each of the first and second side units. These rows of apertures are generally arranged such that there is an aperture adjacent each of the latch bolts which is sized to accommodate pivotally extending one of the latches through the respective one of the apertures for interconnection of the respective one of the side units and the filler. In addition, the pilaster form may include mask means for preventing leakage of concrete through exposed and unused ones of the vertically extending apertures during a concrete pouring operation.

Other objects, advantages and features of the present invention will become apparent from a consideration of the following specification taken in conjunction with the accompanying drawings.

DETAILED DESCRIPTION OF THE PREFERRED EMBODIMENT

Figure 1:
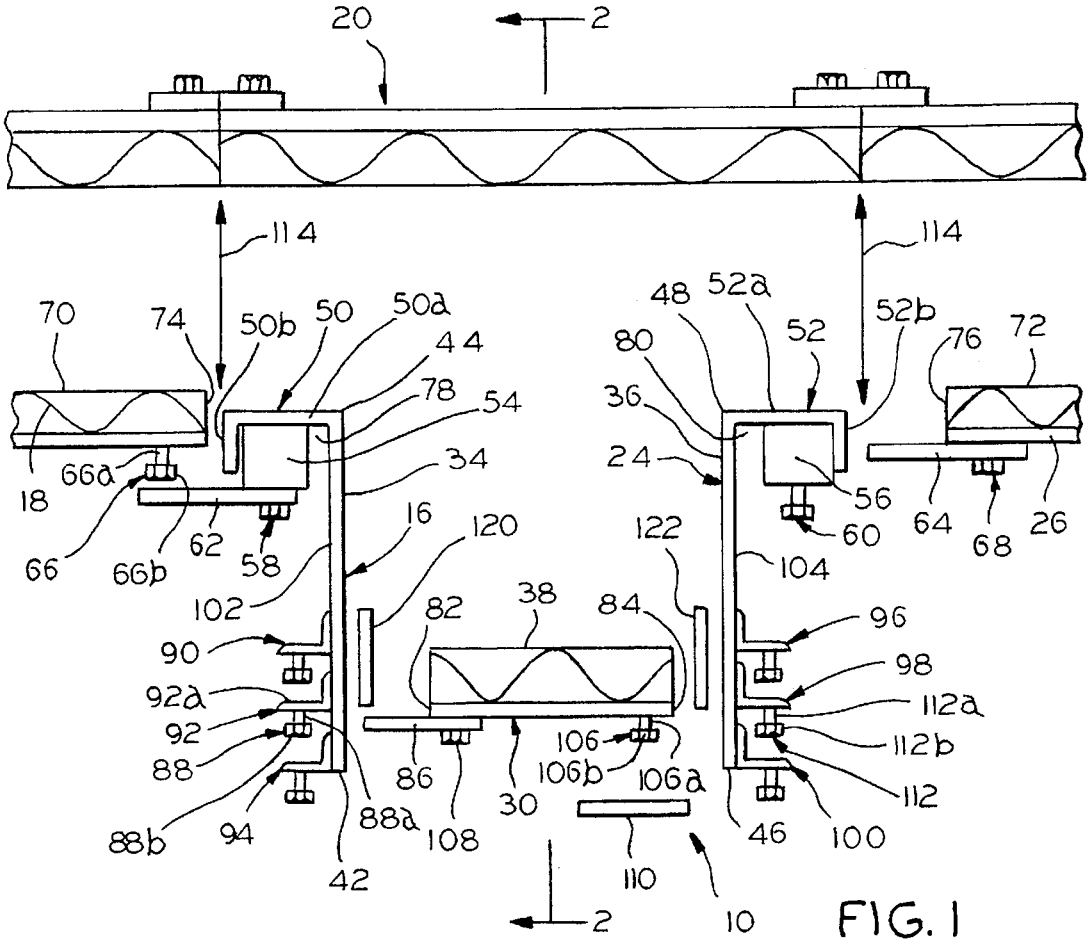
FIG. 1 is a top plan view of a pilaster form in accordance with the present invention.
Figure 1A:
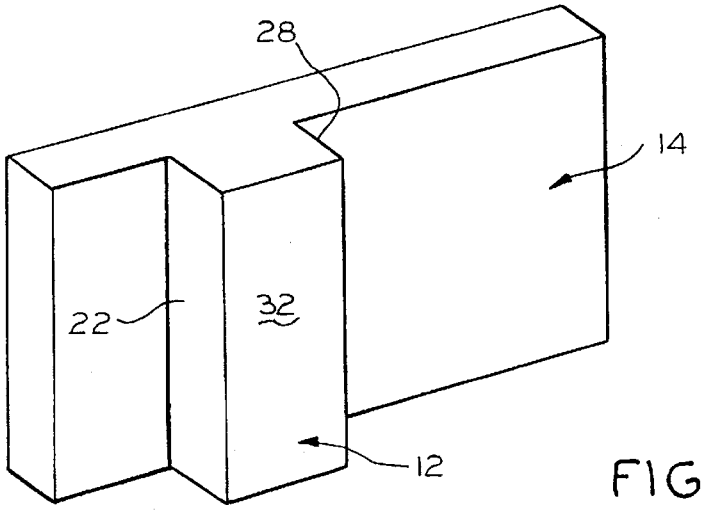
FIG. 1A is a perspective view of a concrete wall formed with the pilaster form of FIG. 1.
Figure 2:
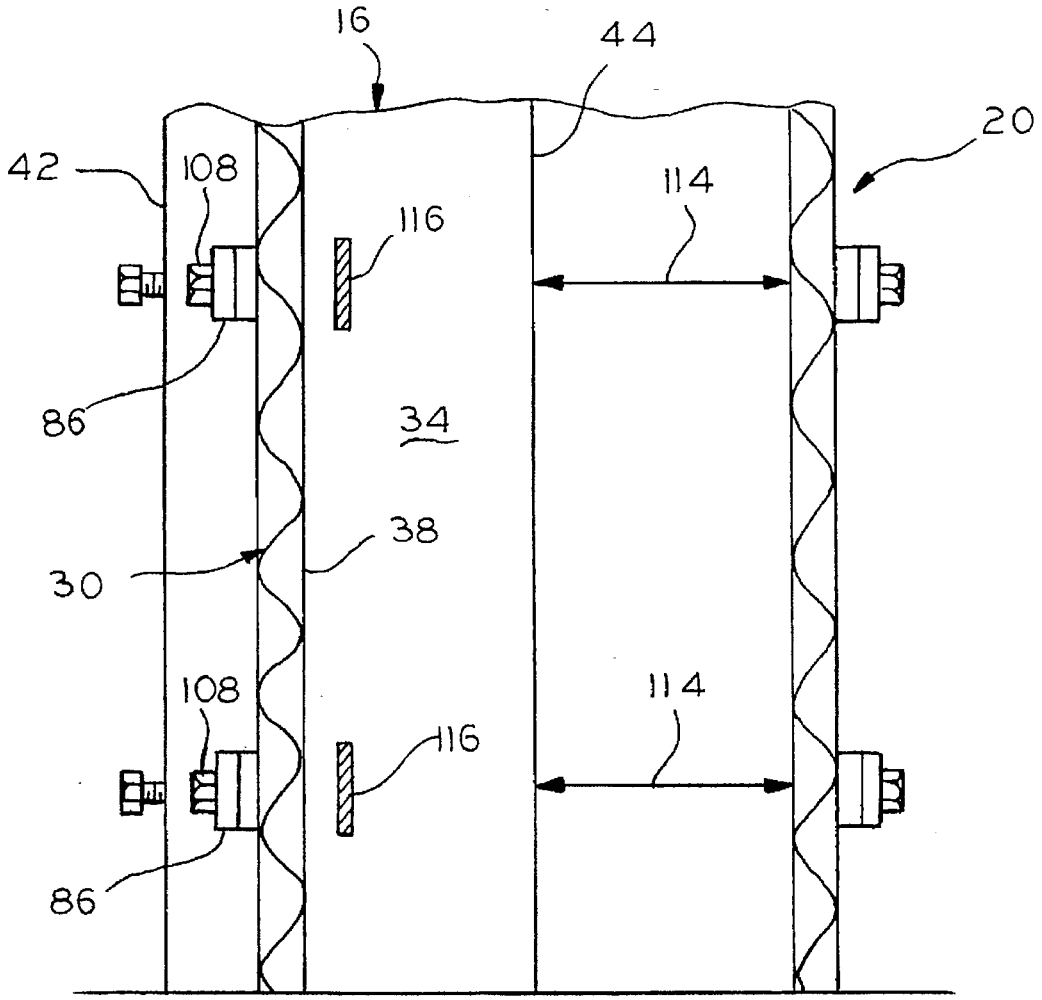
FIG. 2 is a cross-sectional view taken generally along the line 2—2 of FIG. 1.

In the illustrations given, and with reference first to FIGS. 1 and 1A, the reference numeral 10 designates generally a pilaster form which is particularly suited for use in forming a pilaster such as 12 for a concrete wall such as 14. The pilaster form 10 includes a first side unit 16 for interconnection with a first section 18 of a wall form 20 to form a first side 22 of the pilaster 12, a second side unit 24 for interconnection with a second section 26 of the wall form 20 to form a second side 28 of the pilaster 12, and a filler 30 for interconnection with the first and second side units 16 and 24 of the pilaster form 10 to form an outwardly facing surface 32 of the pilaster 12 (FIGS. 1 and 1A). Further, the first and second side units 16 and 24 each have a generally planar face 34 and 36 for forming the sides 22 and 28 of the pilaster 12 and the filler 30 has a generally planar face 38 for forming the outwardly facing surface 32 of the pilaster 12. Referring now to FIGS. 1 and 2, the first and second side units 16 and 24 each also have first and second generally parallel edges 42, 44 and 46, 48, respectively, extending along opposite sides of the corresponding ones of the faces 34 and 36. It will also be seen that each of the first and second side units 16 and 24 has a return bend 50 and 52, respectively, integral with one of the first and second generally parallel edges to provide a wall forming flange **50*a* and 52*a*, respectively, and a wall form abutting flange 50*b* and 52*b*, respectively. Still more specifically, in the illustrated embodiment each of the return bends 50 and 52 will be seen to be integral with the edges 44 and 48, respectively, which are opposite the edges 42 and 46, respectively, as perhaps best shown in FIG. 1**.

Figure 3:
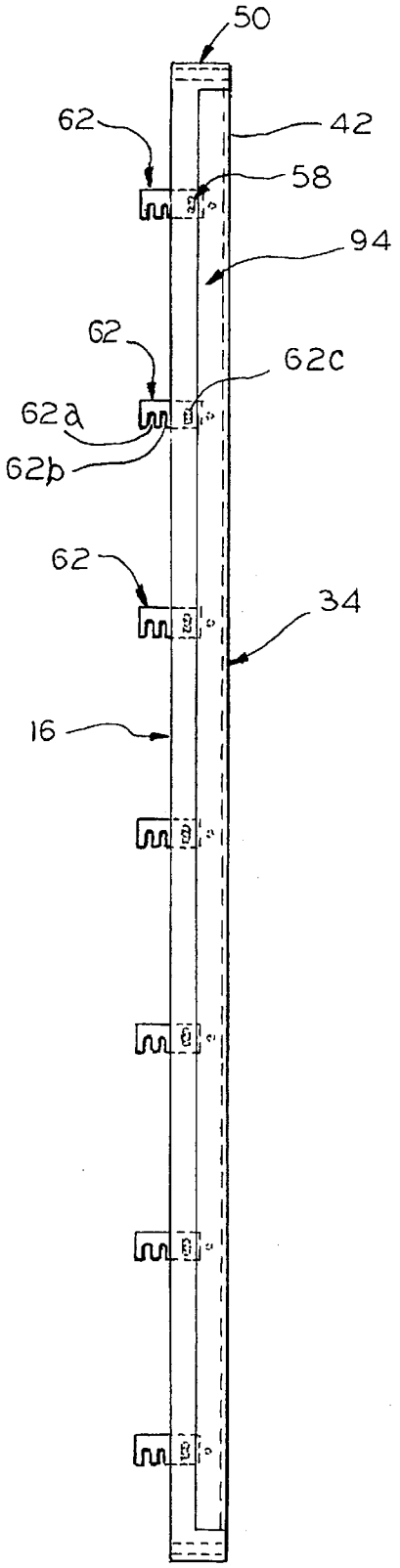
FIG. 3 is a front elevational view of a side unit of the pilaster form of FIG. 1.

As will be appreciated by referring to FIGS. 1 and 3, the pilaster form 10 includes means integral with either the first side unit 16 or the first section 18 of the wall form 20 for releasably securing the first side unit 16 to the first section 18 of the wall form 20. As will also be appreciated by referring to FIGS. 1 and 3, the pilaster form 10 includes means integral with either the second side unit 24 or the second section 26 of the wall form 20 for releasably securing the second side unit 24 to the second section 26 of the wall form 20.

More specifically, in the illustrated embodiment each of the side unit releasable securing means includes a plurality of vertically spaced mounting blocks 54 and 56 integral with the corresponding one of the side units 16 and 24, respectively. It will also be appreciated that each of the vertically spaced mounting blocks 54 and 56 has an integral latch bolt 58 and 60, respectively. As will best be appreciated from FIG. 1, the latch bolts 58 and 60 which are integral with the corresponding vertically spaced mounting blocks 58 and 60 are well adapted for either carrying a latch 62 or receiving a latch 64 substantially as shown.

Still referring to FIG. 1, each of the side unit releasable securing means further includes a latch bolt 66 and 68 which is integral with the corresponding one of the sections 18 and 26 of the wall form 20. It will be appreciated that, in the illustrated embodiment, there will be a plurality of vertically spaced latch bolts 66 and 68 which are generally in proximity to respective edges of the sections 18 and 26 of the wall form 20. With this arrangement, the latch bolts 66 each receive one of the latches 62 carried by the latch bolt 58 and the latch bolts 68 each carry one of the latches 64 to be received by one of the latch bolts 60.

With regard to the wall form 20, and still referring to FIG. 1, each of the sections 18 and 26 will be understood to have a generally planar face 70 and 72, respectively, which is well suited for forming the concrete wall 14. It will also be appreciated that each of the sections 18 and 26 of the wall form 20 have a side edge 74 and 76, respectively, for abutment by one of the wall form abutting flanges 50*b* and 52*b*, respectively. It will further be appreciated that each of the wall form abutting flanges 50*b* and 52*b* has a generally planar surface to be secured in abutment with the side edges 74 and 76, respectively, of the sections 18 and 26, respectively. With this particular arrangement, the wall forming flanges 50*a* and 52*a* will also be understood as having a generally planar face to be secured generally coplanar with the corresponding generally planar faces 70 and 72 of the sections 18 and 26 of the wall form 20.

In the embodiment as illustrated in FIGS. 1 and 3, the mounting blocks 54 and 56 are nested in the vertically extending spaces 78 and 80, respectively, defined by the return bends 50 and 52, respectively, in relation to the remainder of the side units 16 and 24, respectively.

As previously noted, the filler 30 has a generally planar face 38 for forming the outwardly facing surface 32 of the pilaster 12 and it also has first and second generally parallel edges 82 and 84 extending along opposite sides thereof. It will further be appreciated that the pilaster form 10 includes means integral with at least one of the first and second side unit 16 and 24 and filler 30 for releasably securing the filler 30 to the first and second side units 16 and 24 of the pilaster form 10. In accordance with the invention, the filler releasable securing means will be understood as being operable to releasably secure the filler 30 at any one of a plurality of distinct positions in relation to the wall form 20.

Still more specifically, the positions at which the filler is releasably secured are advantageously such as to permit the forming of the pilaster 12 in any of a plurality of different depths in relation to the concrete wall 14. The filler releasable securing means preferably includes at least a plurality of latches such as 86 which are integral with one and a plurality of latch bolts such as 88 which are integral with the other of the corresponding ones of the side units 16 and 24 and the filler 30. Further, the filler releasable securing means includes a plurality of angles 90, 92, 94 and 96, 98, 100 vertically secured in parallel horizontally spaced relation on an outer surface 102 and 104, respectively, of each of the first and second side units 16 and 24, respectively.

As will be appreciated, each of the angles 90, 92, 94 and 96, 98, 100 carry a selected number of the latch bolts such as 88 and each of the latch bolts such as 88 is adapted to receive and/or carry a latch for interconnection with the filler 30. The latch bolts such as 88 each extend generally perpendicular to a flange such as 92*a* of the corresponding one of the angles such as 92 so as to extend in a direction which is generally parallel to the outer surface such as 102 of the respective one of the first and second side units such as 16. With this arrangement, the latch bolts such as 88 each threadingly engage the flange such as 92*a* of the respective one of the angles such as 92 for threaded movement toward and away from the flange such as 92 to capture a latch such as 86 therebetween.

As previously suggested, the pilaster form 10 includes a plurality of the latches 86 which are preferably integrally associated with one of the edges 82 of the filler 30 and a plurality of latch bolts 106 adjacent the other of the edges 84. The latch bolts such as 88 integrally associated with the angles such as 92 of one of the side units such as 16 are adapted to receive a corresponding one of the plurality of latches 86 integrally associated with the one of the edges 82 of the filler 30 as by a latch bolt 108. In addition, the pilaster form 10 utilizes a plurality of latch clips 110 each of which is adapted to be interconnected to one of the plurality of latch bolts 106 integral with the filler 30 adjacent the other of the edges 84.

With these unique features of construction, the latch bolts such as 112 integral with one of the angles such as 98 of the other of the side units such as 24 are each also adapted to receive and be interconnected with a corresponding one of the plurality of latch clips 110. In an alternative embodiment, the latch bolts such as 112 integrally associated with the angles such as 98 of the other of the side units such as 24 each carry a latch (not shown) which is essentially identical to the latch 86. This latch can be interconnected with the filler in much the same way that the latch 86 integral with the filler 30 is interconnected with the one of the side units 16. More specifically, the latches carded by the latch bolts such as 112 associated with the other of the side units such as 24 each can be interconnected with a corresponding one of the latch bolts such as 106 integral with the filler 30.

With regard to the latches such as 86 and the latch clips such as 110, they are not specifically shown in detail in the drawings. It will be appreciated, however, that the latches such as 62 are clearly shown in FIG. 3 and, moreover, the latches such as 86 can be similarly configured, as can the latch clips 110 although the latches 62 are different in one respect, i.e., they each include one slot such as 62*a* to fit over the shank 66*a* and behind the head 66*b* of the latch bolt 66 and they also include another slot such as 62*b* into which a tie (which is schematically illustrated at 114 in FIG. 1) can be secured. Of course, the latches 86 need only have a single slot such as 62*a* to be secured over the shank 88*a* and behind the head 88*b* of the latch bolt 88.

With regard to the latches 62 and 86, they may each be formed so as to have a hole such as 62*c* for the purpose of receiving a latch bolt such as 58 as shown in FIG. 3. It will be appreciated that the latch clip 110 will differ in that it will simply have a slot such as 62*a* in latch 62 to cooperate with the latch bolt 106 and it will also have another essentially identical slot at the end of the latch clip 110 opposite the first-mentioned slot to cooperate with the latch bolt 112. With this arrangement, the parallel slots in the latch clip 110 can be inserted over the shanks 106*a* and 112*a* and behind the heads 106*b* and 112*b* of the latch bolts 106 and 112, respectively.

Figure 5:
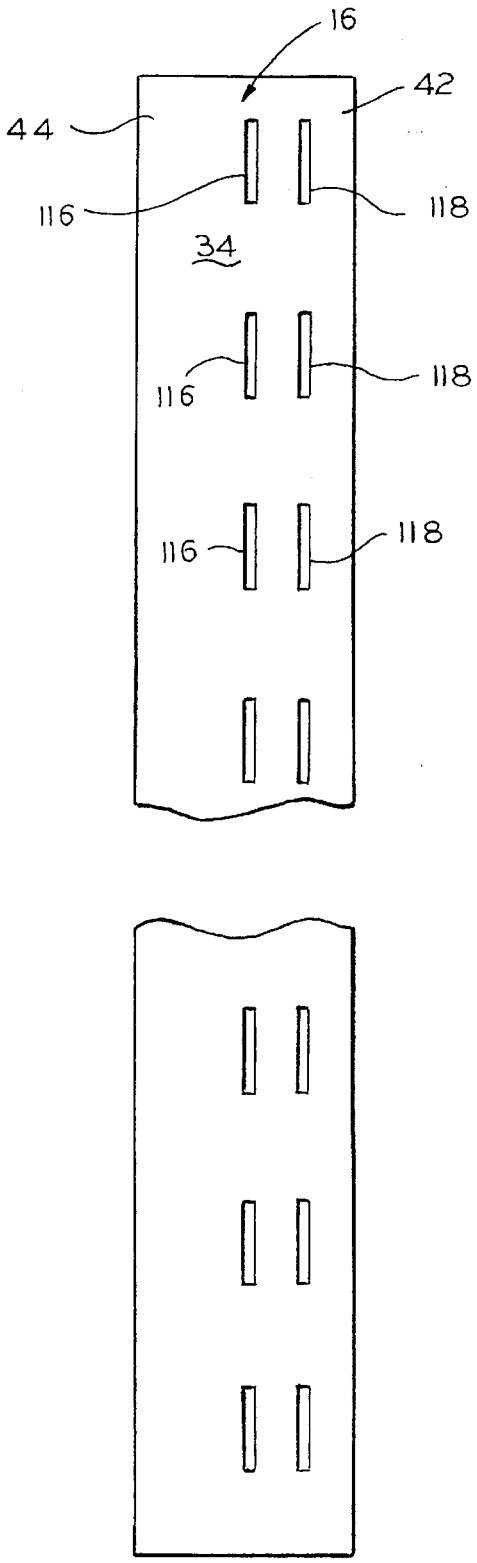
FIG. 5 is a side elevational view of a side unit of the pilaster form of FIG. 1.

Referring now to FIGS. 2 and 5, the filler releasable securing means will be seen to further include a plurality of vertically extending rows of apertures such as 116 and 118 in each of the first and second side units 16 and 24. It will be appreciated that each of these apertures is generally adjacent one of the latch bolts integrally associated with the angles 90, 92 and 96, 98 and they are vertically sized to accommodate pivotally extending one of the latches such as 86 (or a latch clip 110) through the respective one of the apertures for interconnection of the respective one of the side units 16 and 24 and the filler 30 as described above. Still further, the pilaster form 10 may include mask means in the form of thin flat vertical sheets 120 and 122 to prevent leakage of concrete through exposed and unused ones of the vertically extending apertures 116 and 118 during a concrete pouting operation.

With the embodiment illustrated in FIG. 1, it will be appreciated that there need be only a pair of the vertically extending and horizontally spaced rows of apertures 116 and 118. This follows because there is no need for such apertures when the filler 30 is to be secured to the latch bolts integrally associated with the angles 94 and 100 since they are immediately adjacent the edges 42 and 46 of the first and second side units 16 and 24. As a result, when using the latch bolts on the angles 94 and 100, the latches such as 86 and/or latch clips such as 110 need not extend through the surfaces 34 and 36 of the first and second side units 16 and 24.

Figure 4:
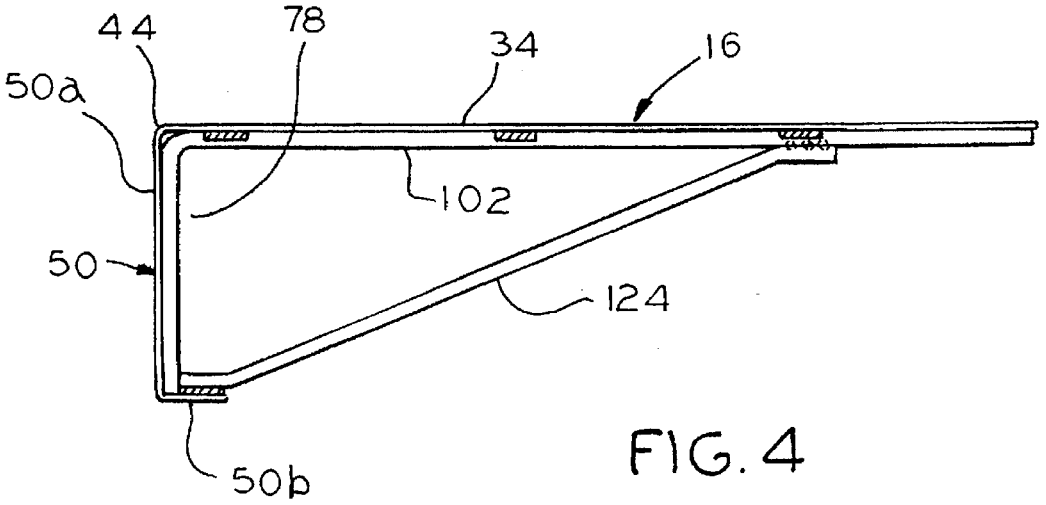
FIG. 4 is a top plan view taken generally along the line 4—4 of FIG. 3.

Referring now to FIG. 4, the first and second side units 16 and 24 may include suitable reinforcing at the top and bottom thereof. It will be seen that the first side unit 16 (which has been illustrated) includes a diagonal brace 124 which suitably extends from the wall form abutting flange **50*b* to the outer surface 102 at a diagonally spaced point. With this arrangement, the diagonal braces 124 at the top and bottom of the first side unit 16** provide stiffness to prevent twisting thereof.

With the present invention, there are two side units, one unit 16 for the left side 22 of the pilaster 12 and one unit 24 for the fight side 28 of the pilaster 12, and the pilaster 12 may be formed of any desired width by using one or more standard concrete forming fillers such as 30 which come in a variety of different widths. In fact, and as will be appreciated by those skilled in the art, more than one such standard filler can be utilized in a known manner depending upon the width which is desired for the pilaster 12. In addition to varying the width, the pilaster form 10 permits the pilaster 12 to be formed in a plurality of depths due to the vertically extending rows of apertures or slots 116 and 118 in the faces 34 and 36 of the side units 16 and 24 in conjunction with the securing angles 90, 92, 94 and 96, 98, 100 and latch bolts integral therewith.

As will be appreciated by those skilled in the art, the first and second side units 16 and 24 can be formed of any suitable material such as steel, aluminum, plastic, etc. The mounting blocks 54 and 56 serve as a base for attaching the latch bolts 58 and 60 which, in turn, keep the latches such as 62 secured to the mounting blocks such as 54 or, alternatively, receives the latches such as 64 secured to an adjacent section such as 26 of the wall form 20. In any event, the latches such as 62, 64, 86, etc. swing over the next adjacent latch bolt such as 66, 60, 88, etc. to connect the sections of the form together as well as serving to capture ties such as 114.

With regard to the securing angles 90, 92, 94 and 96, 98, 100, they serve to stiffen the faces 34 and 36 of the side units 16 and 24 and to also provide a mounting surface for latch bolts such as 88 and 112. With regard to the apertures or slots 116 and 118 in the side units 16 and 24, they permit penetration of a latch such as 86 or a latch clip such as 110 to connect the filler 30 to the side units 16 and 24.

While in the foregoing there has been set forth a preferred embodiment of the invention, it will be appreciated that the details herein given may be varied by those skilled in the art without departing from the true spirit and scope of the appended claims.

We claim:

1. A forming system for use in forming a concrete wall having a pilaster, comprising:

a first section of a wall form having a wall forming surface and a side opposite said wall forming surface, a second section of a wall form having a wall forming surface and a side opposite said wall forming surface; and a pilaster form including:

a first side unit having a pilaster side forming surface and a side opposite said pilaster side forming surface, and a plurality of securing means integral with and spaced along said first side unit and said first section of said wall form on said side opposite said pilaster side forming surface and said side opposite said wall forming surface, respectively, said securing means releasably securing said first side unit to said first section of said wall form;

a second side unit having a pilaster side forming surface and a side opposite said pilaster side forming surface, and a plurality of securing means integral with and spaced along said second side unit and said second section of said wall form on said side opposite said pilaster side forming surface and said side opposite said wall forming surface, respectively, said securing means releasably securing said second side unit to said second section of said wall form; and a filler having a pilaster outwardly facing forming surface and a side opposite said pilaster outwardly facing forming surface, and a plurality of securing means integral with and spaced along said first and second side units and said filler on said sides opposite said pilaster side forming surfaces and said side opposite said pilaster outwardly facing forming surface, respectively, said securing means releasably securing said filler to said first and second side units of said pilaster form;

said filler securing means being operable to releasably secure said filler to said first and second side units at a plurality of points spaced along said first and second side units at any one of a plurality of depth positions in relation to said wall form to permit the forming of said pilaster in a plurality of depths in relation to a concrete wall.

2. The forming system of claim 1 wherein said first and second side units each have a face defining the corresponding one of said pilaster side forming surfaces for forming first and second sides of said pilaster, each of said first and second side units also having first and second edges extending along opposite sides of the corresponding one of said faces.

3. The forming system of claim 1 wherein said side unit securing means each include a plurality of mounting blocks integral with and spaced along the corresponding one of said side units on said side opposite said pilaster side forming surface, each of said mounting blocks having an integral latch bolt for receiving or carrying a latch.

4. The forming system of claim 1 wherein said side unit securing means each include at least a plurality of latches integral with one and a plurality of latch bolts integral with the other of the corresponding ones of said side units and said first and second sections of said wall form on said sides opposite said pilaster side forming surfaces and said sides opposite said wall forming surfaces, respectively.

5. The forming system of claim 1 wherein said filler has a face defining said pilaster outwardly facing forming surface for forming an outwardly facing surface of said pilaster, said face of said filler also having first and second edges extending along opposite sides thereof.

6. The forming system of claim 1 wherein said filler securing means includes at least a plurality of latches integral with one and a plurality of latch bolts integral with the other of the corresponding ones of said first and second side units and said filler on said sides opposite said pilaster side forming surfaces and said pilaster outwardly facing forming surface, respectively.

7. A forming system for use in forming a concrete wall having a pilaster, comprising:

a first section of a wall form having a wall forming surface and a side opposite said wall forming surface, a second section of a wall form having a wall forming surface and a side opposite said wall forming surface; and a pilaster form including:

a first side unit having a pilaster side forming surface and a side opposite said pilaster side forming surface, and a plurality of securing means integral with and spaced along said first side unit and said first section of said wall form on said side opposite said pilaster side forming surface and said side opposite said wall forming surface, respectively, said securing means releasably securing, said first side unit to said first section of said wall form;

a second side unit having a pilaster side forming surface and a side opposite said pilaster side forming surface, and a plurality of securing means integral with and spaced along said second side unit and said second section of said wall form on said side opposite said pilaster side forming surface and said side opposite said wall forming surface, respectively, said securing means releasably securing said second side unit to said second section of said wall form; and each of said first and second side units having a generally planar face defining said pilaster side forming surface for forming first and second sides of said pilaster, each of said first and second side units also having first and second generally parallel edges extending along opposite sides of the corresponding one of said faces;

each of said side unit securing means including a plurality of mounting blocks integral with and spaced along the corresponding one of said side units on said side opposite said pilaster side forming surface and each of said mounting blocks having an integral latch bolt for receiving or carrying a latch; and a filler having a pilaster outwardly facing forming surface and a side opposite said pilaster outwardly facing forming surface, and a plurality of securing means integral with and spaced along said first and second side units and said filler on said sides opposite said pilaster side forming surfaces and said side opposite said pilaster outwardly facing forming surface, respectively, said securing means releasably securing said filler to said first and second side units of said pilaster form;

said filler having a generally planar face defining said pilaster outwardly facing forming surface for forming an outwardly facing surface of said pilaster, said face of said filler also having first and second generally parallel edges extending along opposite sides thereof;

said filler securing means being operable to releasably secure said filler to said first and second side units at a plurality of points spaced along said first and second side units at any one of a plurality of depth positions in relation to said wall form to permit the forming of said pilaster in a plurality of depths in relation to a concrete wall;

said filler releasable securing means including at least a plurality of latches integral with one and a plurality of latch bolts integral with the other of the corresponding ones of said side units and said filler on said sides opposite said pilaster side forming surfaces and said pilaster outwardly facing forming surface, respectively.

8. The forming system of claim 7 wherein each of said side unit releasable securing means further includes a plurality of latch bolts integral with the corresponding one of said first and second sections of said wall form for receiving or carrying a latch.

9. The forming system of claim 7 wherein each of said first and second side units has a return bend integral with one of said first and second generally parallel edges to provide a wall forming flange and a wall form abutting flange.

10. The forming system of claim 9 wherein each of said sections of said wall form has a generally planar face for forming said concrete wall, each of said sections of said wall form also having a side edge for abutment by one of said wall form abutting flanges.

11. The forming system of claim 10 wherein each of said wall forming flanges has a generally planar face to be secured generally coplanar with said generally planar face of one of said sections of said wall form for forming a concrete wall.

12. The forming system of claim 10 wherein each of said wall form abutting flanges has a generally planar surface to be secured in abutment with said side edge of one of said sections of said wall form for forming a concrete wall.

13. A forming system for use in forming a concrete wall having a pilaster, comprising:

a first section of a wall form having a wall forming surface and a side opposite said wall forming surface, a second section of a wall form having a wall forming surface and a side opposite said wall forming surface; and a pilaster form including:

a first side unit having a pilaster side forming surface and a side opposite said pilaster side forming surface, and a plurality of securing means integral with and spaced along said first side unit and said first section of said wall form on said side opposite said pilaster side forming surface and said side opposite said wall forming surface, respectively, said securing means releasably securing said first side unit to said first section of said wall form;

a second side unit having a pilaster side forming surface and a side opposite said pilaster side forming surface, and a plurality_ of securing means integral with and spaced along said second side unit and said second section of said wall form on said side opposite said pilaster side forming surface and said side opposite said wall forming surface, respectively, said securing means releasably securing said second side unit to said second section of said wall form; and each of said first and second side units having a generally planar face defining said pilaster side forming surface for forming first and second sides of said pilaster, each of said first and second side units also having first and second generally parallel edges extending along opposite sides of the corresponding one of said faces;

each of said side unit securing means including a plurality of vertically spaced mounting blocks integrally associated with the corresponding one of said side units, each of said vertically spaced mounting blocks also having an integrally associated latch bolt for receiving or carrying a latch, each of said side unit securing means further including a plurality of latch bolts integrally associated with the corresponding one of said sections of said wall form for receiving or carrying a latch; and a filler having a pilaster outwardly facing forming surface and a side opposite said pilaster outwardly facing forming surface, and a plurality of securing means integral with and spaced along said first and second side units and said filler on said sides opposite said pilaster side forming surfaces and said side opposite said pilaster outwardly facing forming surface, respectively, said securing means releasably securing said filler to said first and second side units of said pilaster form;

said filler having a generally planar face defining said pilaster outwardly facing forming surface for forming an outwardly facing surface of said pilaster, said face of said filler also having first and second generally parallel edges extending along opposite sides thereof;

said filler securing means being operable to releasably secure said filler to said first and second side units at a plurality of points spaced along said first and second side units at any one of a plurality of depth positions in relation to said wall form to permit the forming of said pilaster in a plurality of depths in relation to a concrete wall, said filler also being selected from fillers of a plurality of different widths to permit the forming of said pilaster in any of a plurality of widths in relation to said concrete wall;

said filler securing means including at least a plurality of latches integral with one and a plurality of latch bolts integral with the other of the corresponding ones of said first and second side units and said filler.

14. The forming system of claim 13 wherein said filler securing means includes a plurality of angles vertically secured in parallel horizontally spaced relation on an outer surface of each of said first and second side units, each of said angles carrying a selected number of said latch bolts and each of said latch bolts being adapted to receive and/or carry a latch for interconnection with said filler.

15. The forming system of claim 14 wherein said latch bolts each extend generally perpendicular to a flange of said angle so as to extend in a direction generally parallel to said outer surface of the respective one of said first and second side units, said latch bolts each threadingly engaging said flange of the respective one of said angles for threaded movement toward and away from said flange.

16. The forming system of claim 14 including a plurality of said latches integrally associated with said filler adjacent one of said edges thereof and a plurality of latch bolts integral with said filler adjacent the other of said edges thereof, said latch bolts integrally associated with said angles of one of said side units being adapted to receive a corresponding one of said plurality of said latches integrally associated with said filler adjacent said one of said edges thereof.

17. The forming system of claim 16 including a plurality of latch clips each of which is adapted to be interconnected to one of said plurality of latch bolts integral with said filler adjacent the other of said edges, said latch bolts integral with one of said angles of the other of said side units each being adapted to receive and be interconnected with a corresponding one of said plurality of said latch clips.

18. The forming system of claim 16 wherein each of said latch bolts integrally associated with said angles of the other of said side units carries a latch for interconnection with said filler, said latches carried by said latch bolts integrally associated with said angles of the other of said side units being adapted to be interconnected with a corresponding one of said latch bolts integral with said filler.

19. The forming system of claim 14 wherein said filler securing means further includes a plurality of vertically extending rows of apertures in each of .said first and second side units each generally adjacent one of said latch bolts and sized to accommodate pivotally extending one of said latches through the respective one of said apertures for interconnection of the respective one of said side units and said filler.

20. The forming system of claim 19 including mask means for preventing leakage of concrete through exposed and unused ones of said vertically extending apertures during a concrete pouring operation.

* * * * *

UNITED STATES PATENT AND TRADEMARK OFFICE

CERTIFICATE OF CORRECTION

PATENT NO. : 5,656,193

DATED : August 12, 1997

INVENTOR(S) : Lopez et al.

It is certified that error appears in the above-identified patent and that said Letters Patent is hereby corrected as shown below:

column 2, line 7, after "first" delete ";";

column 6, line 27, please delete "carded" and insert in its place --carried--; and column 11, line 29, please delete "said" and insert --a--.

Signed and Sealed this

Eleventh Day of November, 1997

*Attest:*

Bruce Lehman

BRUCE LEHMAN

*Attesting Officer*

*Commissioner of Patents and Trademarks*